US010895437B2

(12) United States Patent
Freier

(10) Patent No.: US 10,895,437 B2
(45) Date of Patent: Jan. 19, 2021

(54) BALLISTIC UNDERWEAR

(71) Applicant: Blücher GmbH, Erkrath (DE)

(72) Inventor: Katrin Freier, Mönchengladbach (DE)

(73) Assignee: BLUCHER GMBH, Erkrath (DE)

( * ) Notice: Subject to any disclaimer, the term of this patent is extended or adjusted under 35 U.S.C. 154(b) by 865 days.

(21) Appl. No.: 14/435,839

(22) PCT Filed: Oct. 15, 2013

(86) PCT No.: PCT/EP2013/003100

§ 371 (c)(1),
(2) Date: Apr. 16, 2015

(87) PCT Pub. No.: WO2014/060094

PCT Pub. Date: Apr. 24, 2014

(65) Prior Publication Data

US 2015/0247706 A1 Sep. 3, 2015

(30) Foreign Application Priority Data

Oct. 16, 2012 (DE) ..... 10 2012 218 867
Oct. 23, 2012 (DE) ..... 10 2012 110 104

(51) Int. Cl.
*F41H 1/02* (2006.01)
*A41D 13/00* (2006.01)

(52) U.S. Cl.
CPC ..... *F41H 1/02* (2013.01); *A41D 13/0002* (2013.01); *A41D 13/0012* (2013.01)

(58) Field of Classification Search
CPC . F41H 1/02; F41H 5/0485; F41H 1/04; F41H 5/0428; F41H 5/0492; F41H 1/00; F41H 1/08; F41H 5/04; F41H 5/0421; F41H 5/0471; F41H 5/0478; F41H 5/08; F41H 3/00; F41H 5/007; F41H 5/02; F41H 5/023; F41H 5/0407; A41D 13/0002; A41D 13/012; A41D 13/002; A41D 13/00
USPC ..... 2/2.5; 428/113; 66/174
See application file for complete search history.

(56) References Cited

U.S. PATENT DOCUMENTS 5,677,029 A * 10/1997 Prevorsek ..... B32B 5/12 428/105
5,822,791 A 10/1998 Baris
6,961,958 B1 11/2005 Seitzinger
8,561,213 B2 * 10/2013 Howell ..... F41H 1/02 2/2.5
2009/0013451 A1 * 1/2009 Baxter ..... A41B 9/001 2/455
2009/0019612 A1 * 1/2009 Schulein ..... F41H 1/02 2/2.5

(Continued)

FOREIGN PATENT DOCUMENTS

CA 2720569 5/2012
GB 2342278 A 12/2000

(Continued)

*Primary Examiner* — Alissa J Tompkins
*Assistant Examiner* — Catherine M Ferreira
(74) *Attorney, Agent, or Firm* — Edward E. Sowers; Brannon Sowers & Cracraft PC

(57) ABSTRACT

The invention relates to ballistic underwear. The base area of the underwear is composed of shrapnel-resistant UHMWPE knitwear 1 and at least one other, different textile material 2, 200, 14. The UHMWPE knitwear is arranged in a first zone of the base area.

7 Claims, 8 Drawing Sheets

(56) References Cited

U.S. PATENT DOCUMENTS

| | | | | |
|---|---|---|---|---|
| 2010/0050699 | A1* | 3/2010 | Kolmes | A41B 9/00 66/174 |
| 2011/0167998 | A1* | 7/2011 | Lyons | B29C 33/68 89/36.02 |
| 2012/0117700 | A1* | 5/2012 | Howell | F41H 1/02 2/2.5 |

FOREIGN PATENT DOCUMENTS

| | | | | |
|---|---|---|---|---|
| WO | 2005028724 | A2 | 3/2005 | |
| WO | 2010060943 | A1 | 6/2010 | |
| WO | WO 2010060943 | A1 * | 6/2010 | D02G 3/047 |

* cited by examiner

BALLISTIC UNDERWEAR

CROSS-REFERENCES TO RELATED APPLICATIONS

This application is a National Stage filing of International Application PCT/EP 2013/003100, filed Oct. 15, 2013, claiming priority to German Applications DE 10 2012 218 867.3 filed Oct. 16, 2012, and DE 10 2012 110 104.3 filed Oct. 23, 2012, entitled "Ballistic Underwear." The subject application claims priority to PCT/EP 2013/003100, and to DE 10 2012 218 867.3, and DE 10 2012 110 104.3 and incorporates all by reference herein, in their entirety.

BACKGROUND OF THE INVENTION

The invention relates to a ballistic-protective undergarment.

Studies have shown that military personnel, but also the civilian population in crisis regions, in particular in those regions where there is heavy terrorist activity, for example in Afghanistan, is suffering an increasing number of injuries to the lower abdomen, in particular in the genital region. One reason for this is that terrorists are deploying improvised explosive devices (IEDs). IEDs are usually positioned on the ground, directing the blast upward from the ground. This gives rise to primary fragments and secondary fragments, which injure the lower abdomen in particular. The explosion further serves to accelerate particles of sand, dust and dirt. A pressure wave and fire also emanate from the explosive devices.

The prior art, for which reference is made to U.S. Pat. No. 6,961,958 B1, discloses a ballistic-protective undergarment. This ballistic-protective undergarment, for example an underpant, has pockets whereinto the ballistic-protective packets are inserted. The ballistic-protective packets may comprise for example SPECTRAFLEX® ballistic material from Allied Signal Company. It is also known from U.S. Pat. No. 6,691,958 B1 to use aramid fibers or polyethylene fibers, for example Twaron~ and Dyneema™ to produce the protective packets to be inserted into the pockets.

The device known from U.S. Pat. No. 6,961,958 B1 offers comparatively good protection against a frontal bullet, but can only protect inadequately from explosions of the aforementioned improvised explosive devices positioned close to the ground. There is further the risk that the protective packets inserted in the pockets are unintentionally displaced. Moreover, the protective packets are a hindrance to the wearer of the undergarment, for example when he or she has to move while lying on or crawling along the ground.

A further disadvantage of known ballistic-protective underpants is that their protective packets are only inadequately adapted to those places in the lower abdomen which are actually in particular need of protection.

DETAILED DESCRIPTION OF THE INVENTION

Figure 1:
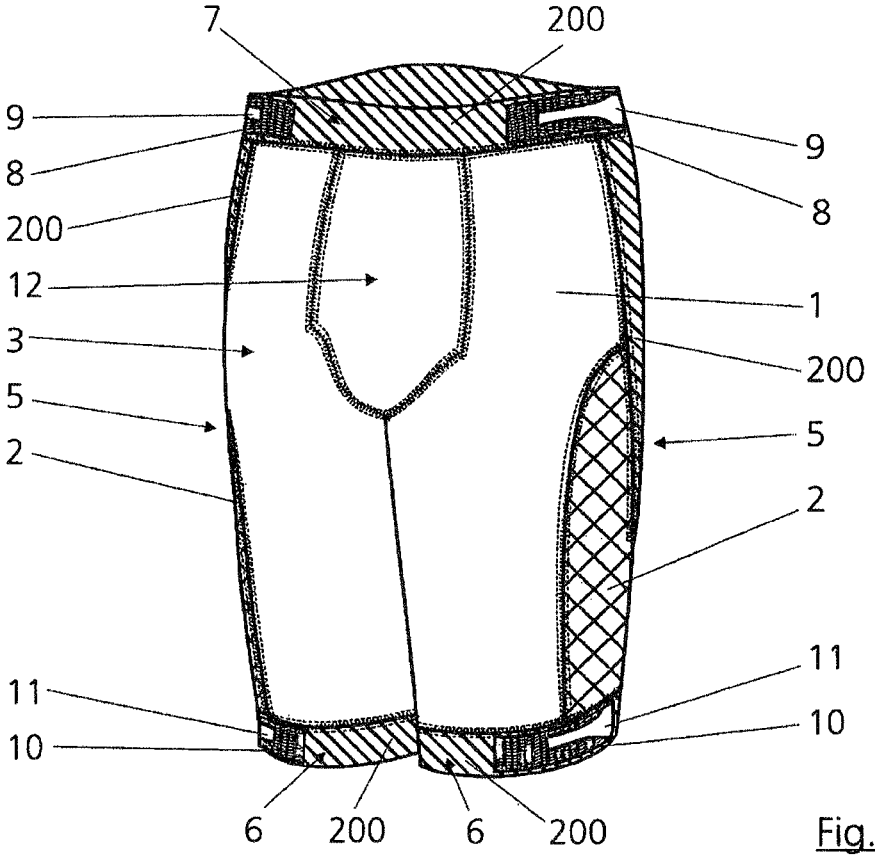
FIG. 1 shows a front view of the inventive undergarment configured as underpant in a first embodiment.

The present invention accordingly has for its object to create a ballistic-protective undergarment which resolves the disadvantages of the prior art, in particular by offering particularly effective protection even from improvised explosive devices positioned close to the ground, which is simple in handling and inconveniences the wearer of the undergarment as little as possible.

This object is achieved according to the present invention by the features of current claim 1.

A study of the injuries caused by improvised explosive devices has shown that the undergarment can be subdivided into various protective zones. The inventor recognized that the undergarment has to meet specific ballistic-protection requirements if it is to be able to offer suitable protection against improvised explosive devices in particular. The invention provides for this that the undergarment shall be assembled from a fragment penetration inhibitor knitted fabric in UHMWPE (ultrahigh molecular weight polyethylene) and at least one different further textile material, wherein the knitted fabric in UHMWPE is arranged in a first zone of the main area of the undergarment.

Given that the undergarment as well as being ballistic protective should also additionally have some other properties, for example offer thermoregulation and an assured fit, it has turned out to be advantageous not for the entire undergarment to be formed of a single knitted fabric capable of inhibiting the penetration of fragments, but essentially only those areas which are in need of special protection. It is accordingly sufficient to arrange the knitted UHMWPE fabric in a first zone of the main area.

Using a knitted fabric in UHMWPE has turned out to be particularly suitable versus other materials which are likewise capable of establishing ballistic protection. The knitted fabric in UHMWPE can be produced so as to ensure an optimum wearing comfort. The penetration of fragments can be minimized. The penetration depth of fragments is reduced and minifragments are kept out virtually completely. The occurrence of life-threatening injuries can thus be reduced. Survivability increases and the risk of infections, which is high for injuries in the genital region in particular, decreases. The knitted fabric in UHMWPE offers virtually unchanged ballistic protection even in the moist state and also after UV aging and after laundering.

In contradistinction to the prior art as known from U.S. Pat. No. 6,961,958 B1, the solution provided by the present invention advantageously enables the undergarment to be assembled from the knitted fabric in UHMWPE and at least one further different textile material. It is accordingly not necessary, as proposed in U.S. Pat. No. 6,961,958 B1, to first produce the undergarment completely of a non-ballistic-protective material and then equip it with pockets for accommodating ballistic-protective packets, instead the undergarment can be assembled from the knitted fabric in UHMWPE and the at least one further different textile material. This may preferably be done by stitching or otherwise joining the individual pieces together at their edges to form a complete undergarment therefrom. A low basis weight is also attained as a result.

A particular advantage is that assembling the undergarment from the knitted fabric in UHMWPE and at least one different further textile material ensures that the ballistic-protective equipment will always be positioned at the intended place to be protected. It is thereby further simple to ensure that the knitted fabric in UHMWPE extends in one piece from a front side to the rear side, protecting in particular also the perineum and the anal region, in particular from fragments blasted upwardly from the ground. Ballistic-protective packets merely inserted into pockets offer nearly no protective effect here.

Although it is advantageous for the undergarment to be assembled from individual pieces of the knitted fabric in UHMWPE and the at least one further textile material, as described above, it may alternatively also be provided that one of the textile materials or a plurality form the entire undergarment and then the knitted fabric in UHMWPE is applied, preferably by stitching, preferably to that side which is remote from the body of the wearer.

That part of the undergarment which is formed by the knitted fabric in UHMWPE may be formed in one or more pieces. In the embodiment of the undergarment as underpant, the part on the front side, the part in the region of the perineum and of the anal region and the part formed on the rear side may preferably be formed in one piece of the knitted fabric in UHMWPE. If desired, the portion of the UHMWPE knitted fabric in the region of the pant legs may also be formed co-integrally in one piece. However, it is preferable for the two pant legs to each be formed separately and joined to the knitted fabric piece, preferably by stitching, which at least partially covers the front side, the perineum and the anal region and also the rear side.

One advantage of forming the undergarment from a knitted fabric in UHMWPE is that it may have a white color, so the color design alone provides a strong contrast to any bleeding that occurs, enabling rapid localization of wounds resulting from severer impacts.

Advantageously, the first zone forms at least that part of the main area of the undergarment which, when the undergarment is donned correctly, at least partially covers one of the hereinbelow recited regions of the human body: a) internal organs, b) liver and/or kidney and/or bladder and/or digestive organs and/or spleen, c) abdomen and urinary tract, d) aorta and venous system, e) perineum and anal region.

It will be readily understood that when the undergarment adjoins any one of the aforementioned regions only partially or not at all, these regions can also not be protected by the undergarment. The invention provides that the undergarment, when donned correctly, covers at least one of the aforementioned regions, so said region benefits from ballistic protection and/or any penetration of fragments is inhibited.

It is preferable for two or more, more preferably all, of the aforementioned regions to be assigned to the first zone. The result of this is particularly suitable protection.

It is advantageous for the undergarment to be formed as underpant. However, the invention is not restricted thereto.

In one embodiment of the undergarment as underpant, the design of the latter is advantageously such that the underpant, when donned correctly by the wearer, has a sufficient upward extent to also cover the navel and encircle the body at this level in the form of a ring. This has the advantage that the undergarment overlaps with any protective vest worn in addition. More particularly, on the posterior side of the person wearing the undergarment, the kidneys can additionally also be fully protected by the undergarment and any protective vest.

It is further advantageous for the undergarment when embodied as underpant to extend to the knee of the wearer, preferably to end directly above the knee when the wearer has donned the underpant correctly.

It is advantageous for the at least one further textile material to form at least one second zone. The second zone may be defined as a zone which needs less protection and where other properties, for example the establishment of air circulation, are to the fore. The textile material of the second zone may also be formed such that an optimum fit and/or a wearing comfort is augmented. The textile material may further be selected to enable/augment sweat management, i.e., the removal of perspiration from the body and/or thermoregulation.

It may be advantageous to provide a third zone formed of a third textile material other than the textile material of which the first and second zones are formed.

It is advantageous for the knitted fabric in UHMWPE to be produced by weft knitting with independently-movable needles and/or for it to be a weft-knitted fabric produced by weft knitting with independently-movable needles. The inventor recognized that a knitted fabric produced by weft knitting with independently-movable needles is particularly useful for providing ballistic protection to the undergarment. As a result of the knitted fabric being produced by weft knitting with independently-movable needles, the knitted fabric is breathable and air-permeable, which is particularly pleasant for the wearer.

It may be advantageous for the knitted fabric in UHMWPE to be rendered antibacterial.

The ballistic-protective knitted fabric may have hydrophilic properties.

It is advantageous for the UHMWPE fabric produced by weft knitting with independently-movable needles to have a very high stitch density.

It is further advantageous when the knitted fabric has a basis weight of not less than 150 g/m$^2$, preferably 200 g/m$^2$, more preferably 250 g/m$^2$, most preferably 300 g/m$^2$. It is advantageous when the basis weight is less than 400 g/m$^2$. A basis weight of 300 g/m$^2$ to 360 g/m$^2$, in particular 320 g/m$^2$ to 330 g/m$^2$, has turned out to be very particularly suitable.

It is advantageous when the linear density of yarn used for producing the knitted fabric in UHMWPE is not less than 50 dtex, preferably not less than 80 dtex. It is advantageous when the linear density of the yarn used for producing the knitted fabric in UHMWPE is less than 440 dtex, preferably less than 280 dtex. A 100 to 120 dtex, preferably 110 dtex, yarn has turned out to be particularly suitable for producing a knitted fabric in UHMWPE.

It is advantageous when the knitted fabric in UHMWPE is produced from Dyneema® polymeric fiber, as developed by the Dutch company Royal DSM N.V.

It may be advantageous for the knitted fabric in UHMWPE to be weft knitted using a doubled yarn and independently-movable needles.

It may be provided according to the present invention that the loops of the knitted fabric in UHMWPE are formed such that a pattern of mutually parallel longitudinal ribs is formed in the principal areas, i.e., the top side and the bottom side, of the knitted fabric. Perspiration removal is particularly good when the knitted fabric has longitudinal ribs extending in a parallel arrangement.

In this case, the capillary effect can be particularly effective in removing the sweat from the body to the outside. The sweat is removed from the body of the wearer without the material feeling moist. This is also associated with a cooling effect. It is thus completely unproblematical for the wearer of the undergarment to come into direct contact with the ballistic-protective knitted fabric in UHMWPE.

It is advantageous when the at least one further textile material is arranged in at least one second zone of the main area of the undergarment and is joined, preferably stitched, to the knitted fabric in UHMWPE.

It is advantageous when the zones are stitched together in the region of their mutually adjoining edges.

The undergarment may also have more than two zones and correspondingly more than two different textile materials.

It is advantageous when the zones, if they overlap at all, only overlap in the region of their mutually adjoining edges. If desired, an overlap may also be eschewed entirely when this turns out to be suitable in particular with regard to the preferably provided stitching together of the zones.

It is advantageous when the at least one further textile material and the knitted fabric in UHMWPE are stitched together. It is further advantageous when the knitted fabric in UHMWPE and the at least one further textile material are stitched together in the region of their mutually adjoining edges and the knitted fabric in UHMWPE and the at least one further textile material overlap, if at all, only in the region of their mutually adjoining edges.

It is advantageous when the undergarment has pant legs which have a pant leg cuff at their ends to secure the pant legs in place on the person wearing the undergarment which is elastic and/or adjustable to the wearer of the undergarment, in particular on the legs of the wearer. It is a significant disadvantage of the prior art that the known ballistic-protective underpants cannot be made to stay in place in the region of the pant legs. As a result, the ballistic protection does not work reliably where it should. Particularly in the event of an explosion emanating from the ground, the pant legs and thus also the ballistic-protective packets will become displaced. This is prevented by an adjustable or elastic, preferably an elastic and adjustable pant leg cuff. Cuff adjustability is attainable for example by providing a hook-and-loop closure, to widen or narrow the end of the pant leg and/or the pant leg cuff. A similar configuration is also possible at the other end of the underpant, i.e., in the region where the underpant encircles the wearer in the waist region thereof. Again, an elastic cuff and/or an adjustable cuff, preferably by using a hook-and-loop closure, may be provided here. The materials for all the three cuffs may be the same.

The waistband cuff and/or the two pant leg cuffs and/or the seam of the pant legs may be individually conformable to any body shape via hook and loop, and thus hold the underpant in position.

The elastic material of which the waistband and/or cuffs are made may be a polyamide-elastane blend, which is preferably used in combination with a rubber band integrated therein. Again, other configurations are also conceivable here to establish elasticity.

The configuration of the waistband in an elastic material and/or the use of a hook-and-loop closure can be used in all versions of the undergarment which are described. Similarly, an elastic configuration and/or a configuration with a hook-and-loop closure regarding the pant leg cuffs can be used in all the versions of the undergarment which are described, including in particular all versions which are described hereinbelow with reference to the exemplary embodiment.

In one advantageous embodiment, at least two plies/layers of knitted fabric in UHMWPE are arranged on top of each other in the first zone.

This creates an enhanced protective effect without a disproportionate rise in manufacturing costs.

In one advantageous embodiment, the two plies of knitted fabric in UHMWPE are arranged on top of each other by being twisted 90° relative to each other and in a plane-parallel alignment. The inventor recognized that twisting the at least two plies by 90° relative to each other provides high stability against pulling in both directions of the principal surfaces. This is advantageous in particular when the plies of the knitted fabric each have longitudinal ribs which as a result of the 90° twisted arrangement thus extend at right angles to each other. When more than two plies are used, they may be twisted by 90° relative to each other in an alternating fashion, so for example the first and third layers and a second and a fourth layer are co-aligned. However, other arrangements are also conceivable here.

In one advantageous embodiment, the further textile material arranged in the second zone is formed as a textile mesh having open and air-permeable pores. A warp-knitted polyester fabric having a holey structure may be concerned here for example. The textile mesh may be antibacterial or have an antibacterial finish. The use of mesh outside the first zone and/or in the second zone has the advantage that the undergarment thus has a high level of air permeability and/or makes a flow of air possible.

In one advantageous embodiment, the further textile material arranged in a third zone is formed as an elastic textile material. The elastic textile material has the advantage that the undergarment, in particular an underpant, is able to fit closely to the body shape. To attain an optimal level of wearing comfort, it is advantageous for the undergarment to be close fitting. It has turned out to be advantageous in this connection for the side panels of the undergarment, i.e., the regions of the undergarment in lateral apposition to the person wearing the undergarment to be formed of an elastic material. The elastic material may be, for example, a stretch fabric. The elastic textile material may also be used to form the two cuffs of the pant legs and/or the waistband. This is particularly advantageous in combination with cuff/waistband adjustability, preferably by means of hook-and-loop closures, as described above.

The elastic textile material may preferably be produced from a polyamide-elastane blend. It may be advantageous in this connection to use 50 to 90% of polyamide, preferably 60 to 80%, more preferably 70 to 75% of polyamide while the elastane has a corresponding value in order for the blend to be formed of 95-100%, preferably 100%, of polyamide and elastane.

The elastic textile material may be antibacterial or have an antibacterial finish. The elastic textile material may be hydrophilic or have a hydrophilic finish.

The elastic textile material may preferably be produced by weft knitting with independently-movable needles and/or be a weft knit produced by weft knitting with independently-movable needles.

In one advantageous embodiment, the further textile material arranged in the second zone is formed as a flame-retardant textile material and at least one layer of a flame-retardant material is arranged in the first zone to be plane-parallel to the knitted fabric in UHMWPE. This embodiment renders the undergarment flame retardant and thus enhances the protection for the wearer.

It may be advantageous in this connection for the undergarment to have only two or essentially only two zones. In this case, the flame-retardant textile material may be arranged in the second zone. Further in this case, a textile mesh with open pores and/or an elastic textile material may be eschewed in favor of the flame-retardant textile material. In the first zone, where the invention provides that the knitted fabric in UHMWPE be used, a layer of a flame-retardant material may be arranged on the knitted fabric in UHMWPE in a plane-parallel arrangement. It is advantageous in this connection for the flame-retardant material to be next to the body of the wearer and thus for the knitted fabric in UHMWPE to be arranged on the outer surface of the undergarment.

It is advantageous for the flame-retardant textile material to be used exclusively in the second zone, i.e., the second zone consists exclusively of the flame-retardant textile material. In the first zone, the flame-retardant material, which is arranged on the knitted fabric in UHMWPE, may itself already have a layer of UHMWPE, albeit preferably at a lower basis weight and with a lower stitch density than the fragment penetration inhibitor UHMWPE knitted fabric provided according to the present invention. However, the fact that the layer of flame-retardant material also has a UHMWPE layer extending plane-parallel thereto serves to improve even further the overall ballistic protection.

The flame-retardant layer may preferably be produced from an aramid-elastane blend or from a blend comprising at least aramid and elastane. In a two-ply configuration of the flame-retardant material, one ply may consist of the aramid-elastane blend or of a blend comprising at least aramid and elastane, and the other ply may consist of polyethylene, in particular UHMWPE. This provides enhanced protection from fragments.

A particularly suitable starting material for producing the flame-retardant layer is a blend which in addition to aramid and elastane further includes a third material, in particular polyamide antistatic (PAAS). The flame-retardant material may preferably consist of 70 to 95% aramid, 1 to 5% polyamide antistatic and elastane (e.g., Lycra) in a percentage resulting overall in a blend formed of the three materials to an extent from 98 to 100%. Using a yarn consisting of aramid to an extent of 90%, of elastane to an extent of 7% and of polyamide antistatic to an extent of 3% has turned out to be particularly suitable. This embodiment is commendable irrespective of whether the flame-retardant layer is formed in one ply or two plies, i.e., in a combination with a ply of polyethylene.

A two-ply configuration of the flame-retardant layer may be in particular a weft-knitted fabric produced by weft knitting with independently-movable needles.

The blend which is usable for the flame-retardant layer is preferably antibacterial or has an antibacterial finish.

Not only the waistband of the undergarment but also the two pant leg cuffs and the side inserts/portions of the undergarment are preferably produced from a blend comprising at least aramid and elastane.

Flame retardancy can be used in all versions described in connection with this invention, including in particular all versions described hereinbelow with reference to the exemplary embodiment.

In one advantageous embodiment, textile absorptive areas are formed in the first zone at least portionally on that, bottom side of knitted fabric in UHMWPE which faces the wearer of the undergarment. This makes for a particularly effective form of perspiration and hygiene management. Perspiration removal to the outside is distinctly improved by the absorbtive areas. It is possible to achieve in particular a particularly good antibacterial effect and an odor control effect. The textile absorbtive areas may preferably extend in the genital region and/or in the perineum and anal region and/or in the renipelvic region and/or in strip form along and/or across on the thigh. Tracks of sweat are thus interrupted and the sweat is transported to the outside. Odors and liquids are transported away from the body.

A spherical absorptive laminate is particularly useful for forming the textile absorptive area. More particularly, it has turned out to be advantageous to use a textile absorptive area comprising activated carbon. SARATOGA@ is the trade name under which Blücher Technologies of Germany markets an absorptive laminate that has turned out to be particularly suitable for the textile absorptive area. It may be advantageous in this connection for the textile absorptive area to have three plies. A first ply, which preferably faces the body, may consist of a cotton-elastane blend. A second layer of the textile absorptive area may consist of activated carbon. A third, body-remote layer of the textile absorptive area may be produced from polyamide. The layer of polyamide may therein adjoin the knitted fabric in UHMWPE.

Alternatively, the absorptive area may also be formed of just one or two plies, for example of the ply of activated carbon and a further, freely choosable ply.

The textile absorptive area preferably adjoins the body of the wearer of the undergarment directly and/or is in contact with the body.

The strips of the textile absorptive area which extend in the region of the thigh may subdivide the knitted fabric in UHMWPE into two or more distinct fields/areas.

Textile absorptive strips can be used in all versions of the undergarment which are described in connection with this invention, including in particular all versions described hereinbelow with reference to the exemplary embodiment.

In one embodiment of the invention, in the regions adjoining the thighs when the undergarment is donned correctly and/or a genital region there is formed a pocket whereinto are insertable protective packets conformed to the particular pocket.

So it is preferable for one protective packet for the genital region and two leg-protective packets to be concerned here.

The protective packets may preferably be formed of a fragment penetration inhibitor knitted fabric in UHMWPE. The knitted fabric concerned here may be the same as also forms the first zone.

The protective packets may preferably be formed in at least two plies, for example in four plies or eight plies. In one advantageous embodiment, the protective packets are formed by at least four, preferably eight superposed plies of knitted fabric in UHMWPE.

Tests have shown that eight-ply UHMWPE knitted fabric for example offers a particularly high level of protection, including in particular against a frontal bullet.

The construction of pockets whereinto protective packets for the genital region and/or the thighs can be introduced is possible for all the versions of the undergarment which are described in connection with this invention.

The protective packets may be flame retardant. Any flame retardancy may be used for this purpose, including in particular the flame retardancy already described in connection with the invention.

It may be advantageous for the textile material which is used to form the pockets to be flame retardant, in particular when mesh is concerned here.

It may be advantageous for the pocket provided for accommodating the genital-protective packet to be reachable from the inside surface of the undergarment.

It may be advantageous for the pockets to accommodate the leg-protective packets to be reachable from the outside. It may be provided that the leg-protective packets protect primarily the principal blood vessels extending in the region of the thigh, i.e., are appropriately arranged on the undergarment and engineered in their shape.

To form the protective packets in two or more plies, it may be provided that half of the plies are quilted together in each case. To form one protective packet, therefore, two protective sub-packets are initially formed. These may then be stitched together preferably in the region of their outside edges. In one advantageous configuration of protective packets having eight plies, therefore, it may be provided that four plies are stitched together in each case. The sub-packets formed as a result, each in four plies, may then be stitched together in the outside region to form one protective packet in eight plies. The protective packets, in particular the leg-protective packets are preferably securable by means of a hook element to the loop element of the waistband. It will be appreciated that some other way of securing the protective packets is also possible, including in particular some other form of engineering the hook-and-loop closure.

The pockets for accommodating the protective packets may preferably be formed by a textile mesh. A mesh with open and air-permeable pores is particularly preferable. The mesh may be mounted/stitched on the outside surface of the knitted fabric in UHMWPE to form the pockets for the leg-protective packets. The pockets for the genital region may likewise be produced by means of a mesh, which is mounted/stitched on the inside surface of the knitted fabric in UHMWPE for example.

To form a pocket for the genital-protective packet, the knitted fabric in UHMWPE may also be formed at least in the genital region of two layers which may be arranged such that they form an insertion slot whereinto the genital-protective packet can then be inserted.

It is advantageous for the undergarment to be worn close to the body. It is especially advantageous for the UHMWPE knitted fabric provided according to the invention to be in direct apposition to the body. Departure from this may be possible in particular when flame retardancy and/or textile absorptive areas are provided.

The slits for inserting the leg-protective packet and/or the genital-protective packet into the corresponding pockets are preferably located in an upper region when the undergarment is donned correctly.

It is advantageous for the undergarment to have flat, nonrubbing seams.

It is advantageous to use a knitted fabric in UHMWPE that has a high level of moisture imbibition, in particular with a DIN EN 31092 Ret value of 4.3895 $m^2 \times Pa/W$+/−20%, preferably +/−5%, based on a one-ply form of the knitted fabric in UHMWPE.

Figure 2:
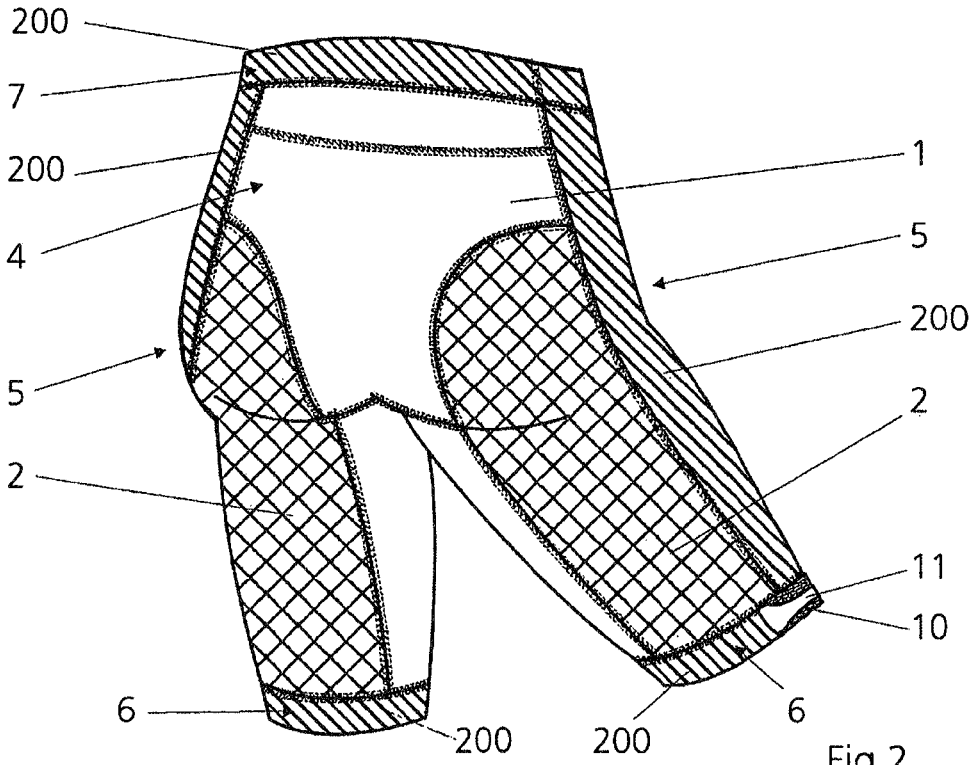
FIG. 2 shows a rear view of the underpant depicted in FIG. 1.
Figure 3:
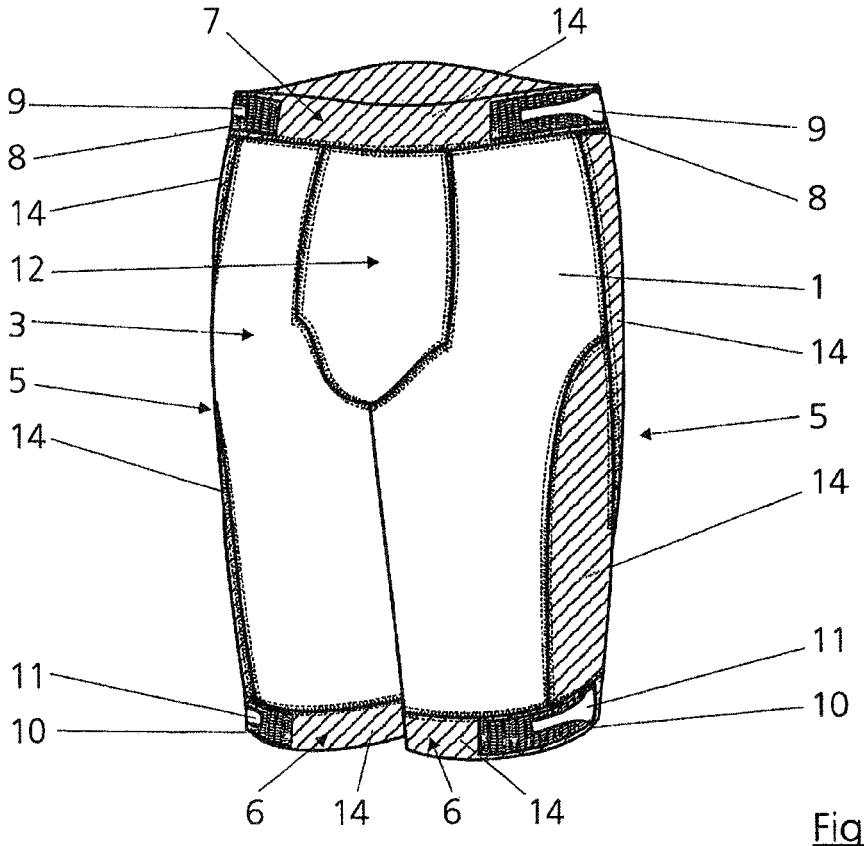
FIG. 3 shows a front view of the inventive undergarment configured as underpant in a second embodiment equipped with flame retardancy.
Figure 4:
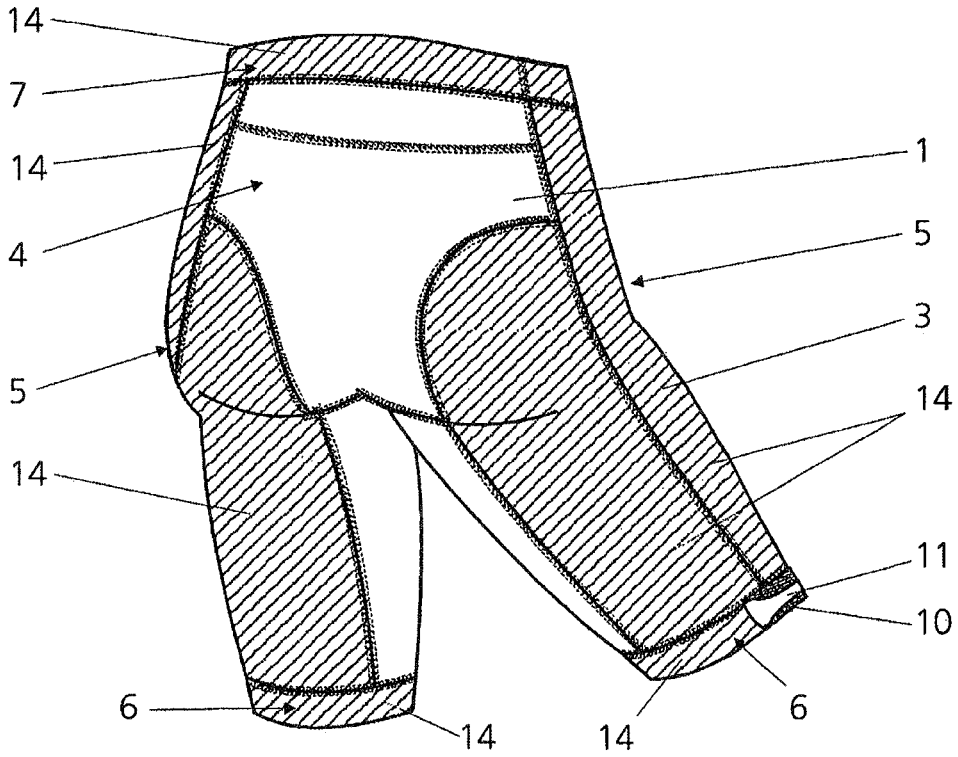
FIG. 4 shows a rear view of the underpant depicted in FIG. 3.
Figure 5:
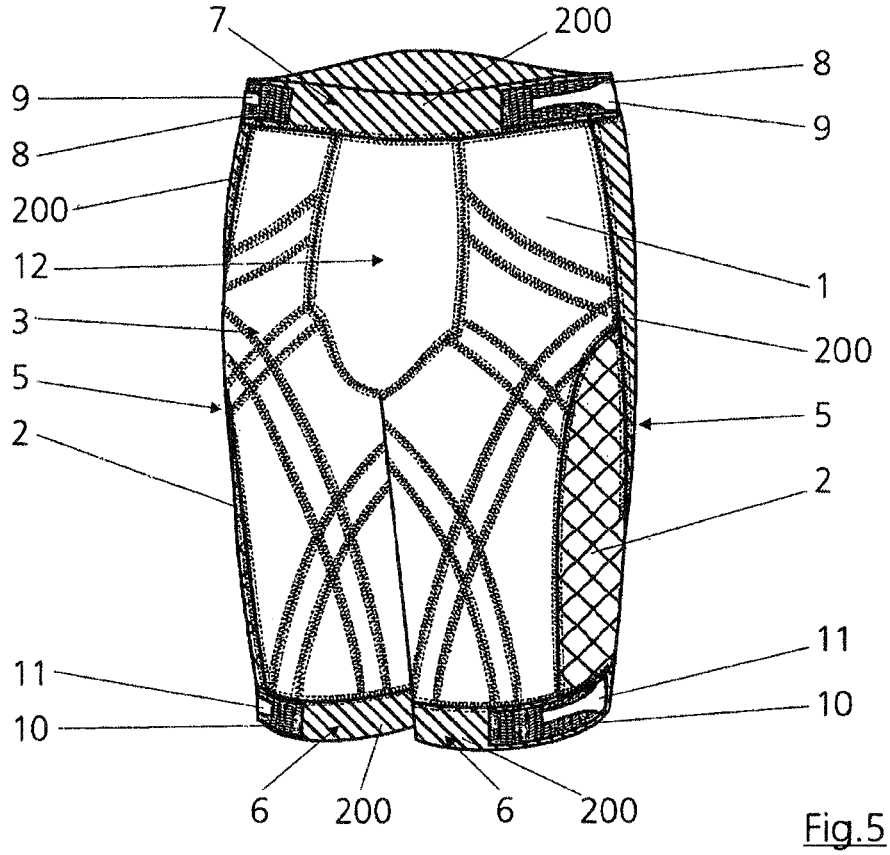
FIG. 5 shows a front view of the inventive undergarment configured as underpant in a third embodiment in a particularly hygienic configuration.
Figure 6:
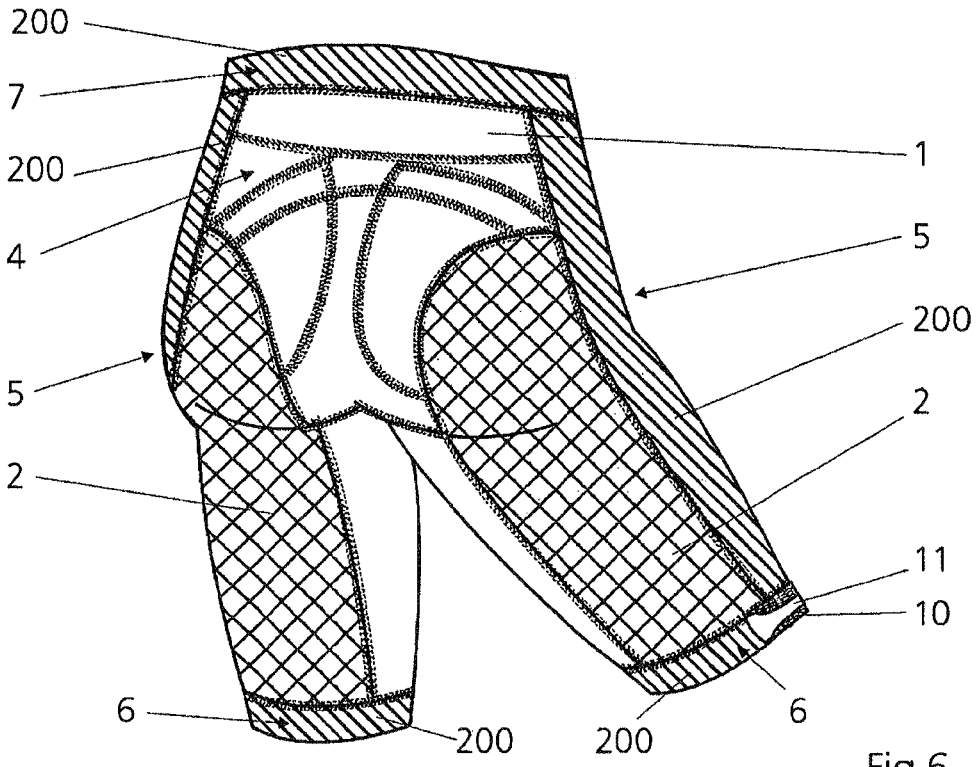
FIG. 6 shows a rear view of the underpant depicted in FIG. 5.
Figure 7:
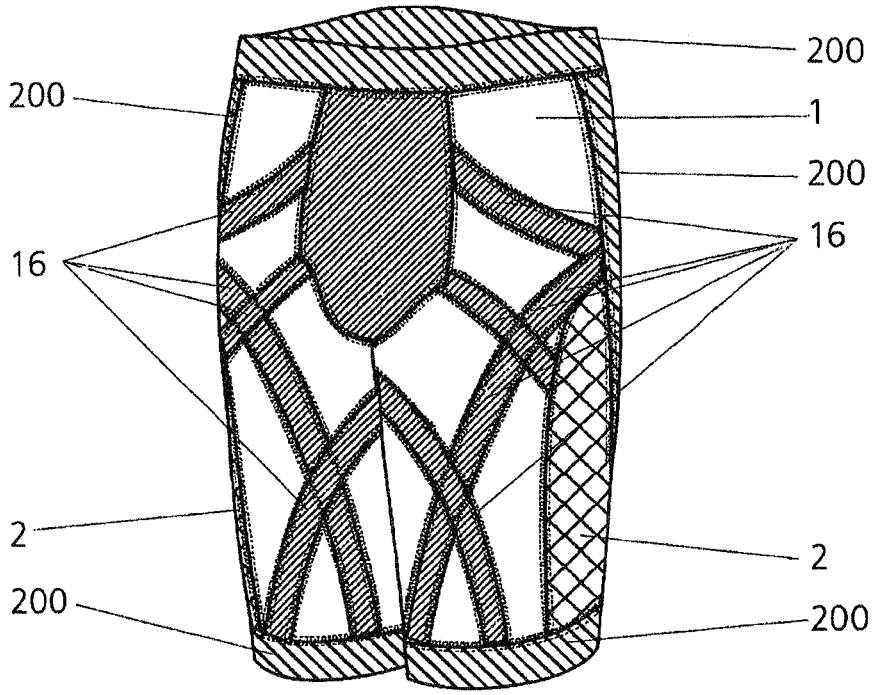
FIG. 7 shows an internal view of the FIG. 5 external view of the underpant.
Figure 8:
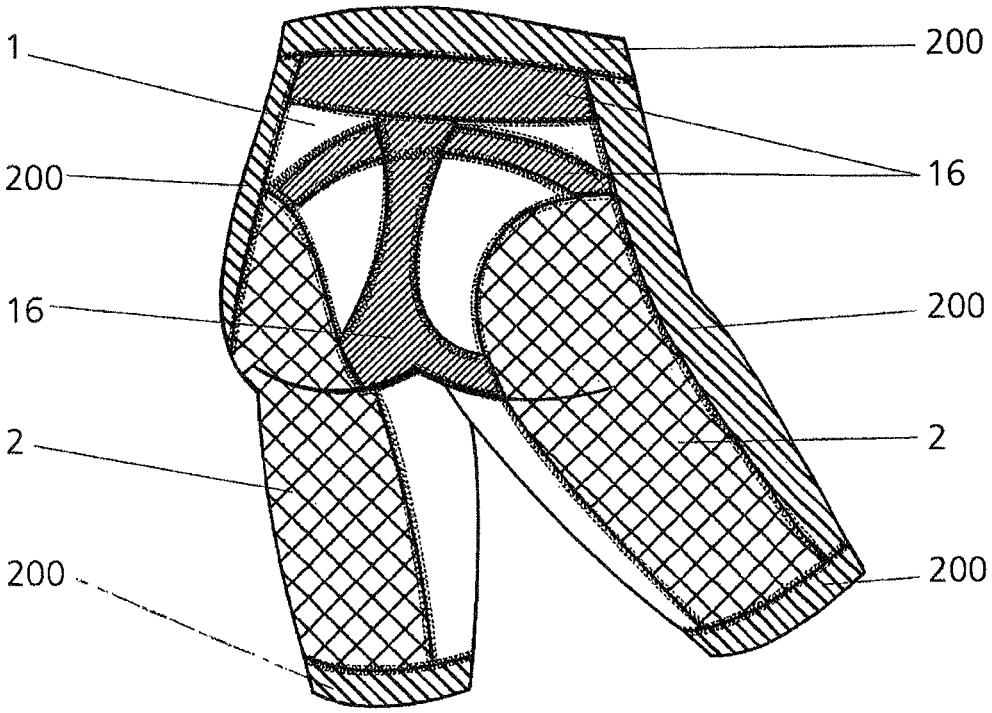
FIG. 8 shows an internal view of the FIG. 6 external view of the underpant.
Figure 9:
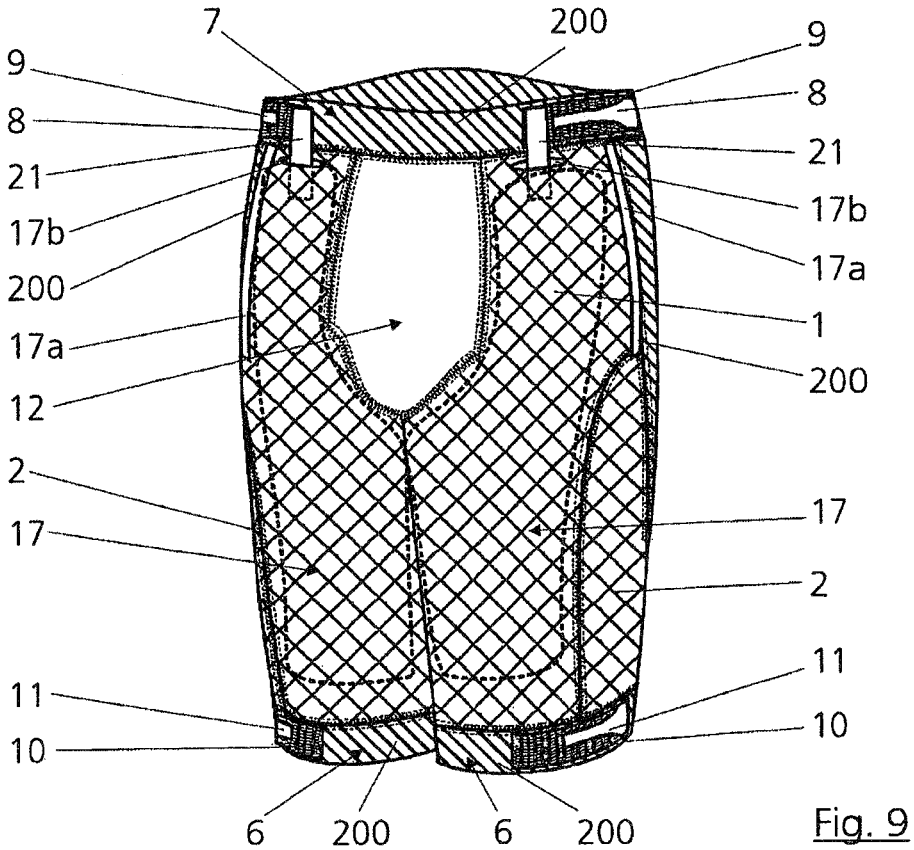
FIG. 9 shows a front view of the inventive undergarment configured as underpant in a fourth embodiment with pockets to accommodate protective packets.
Figure 10:
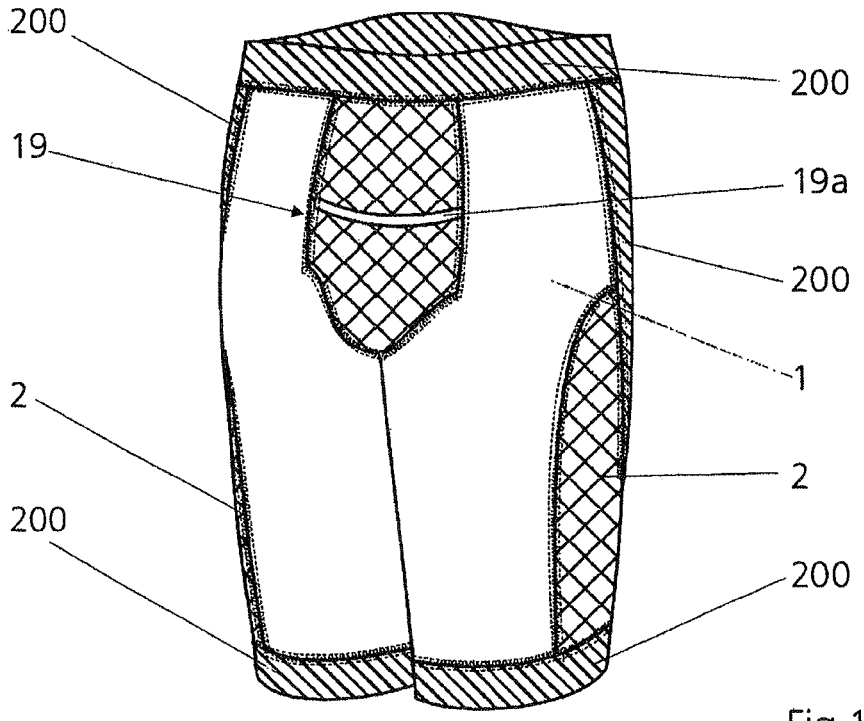
FIG. 10 shows an internal view of the FIG. 9 external view of the underpant with a view of a pocket for receiving a genital-protective packet.
Figure 11:
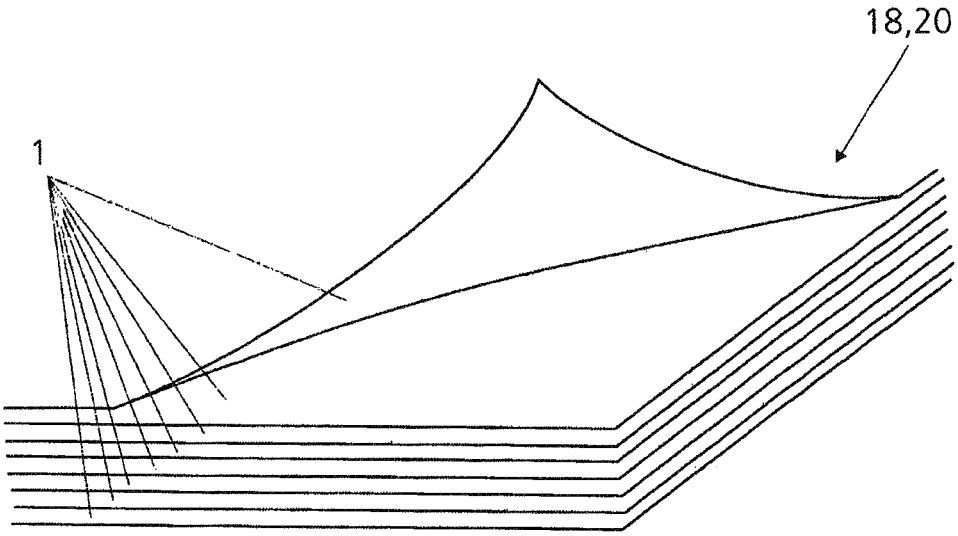
FIG. 11 shows an in-principle depiction of a cut through a protective packet consisting of eight plies.
Figure 12:
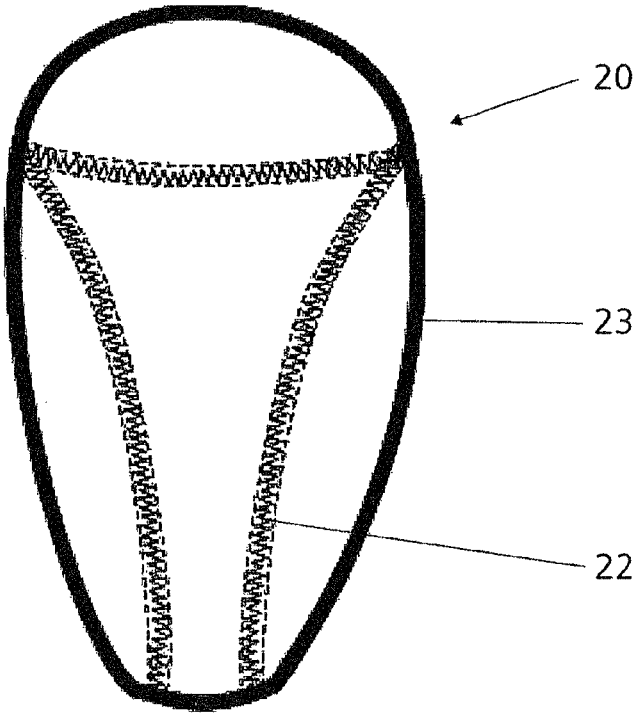
FIG. 12 shows a plan view of a genital-protective packet.
Figure 13:
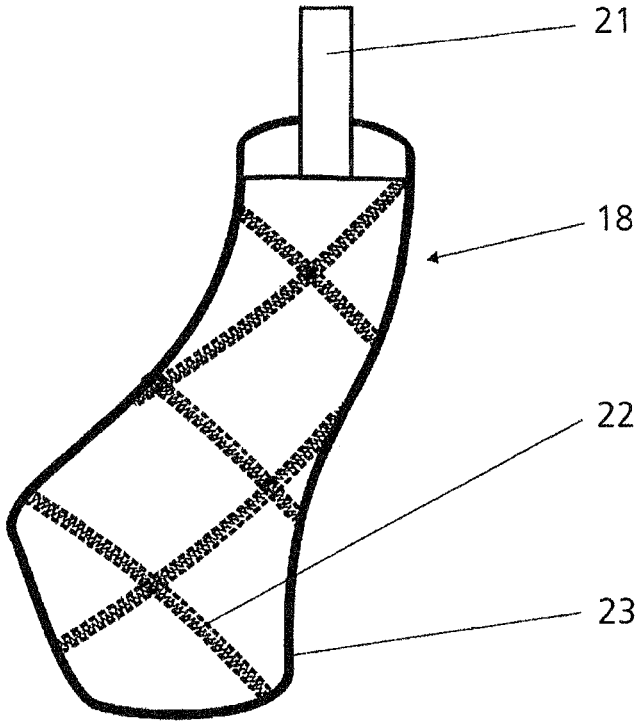
FIG. 13 shows a plan view of a leg-protective packet.
Figure 14A:
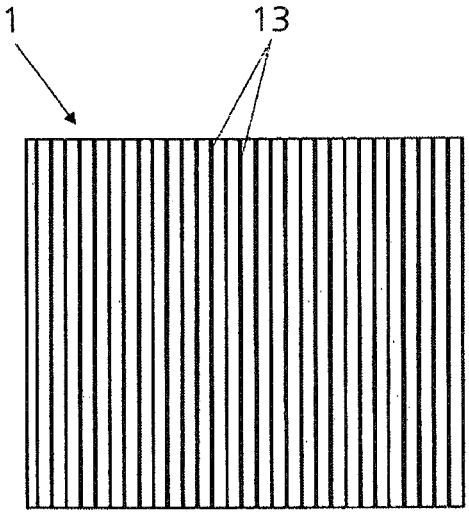
FIG. 14*a* shows an in-principle depiction of a section of knitted fabric in UHMWPE having downwardly extending longitudinal ribs.
Figure 14B:
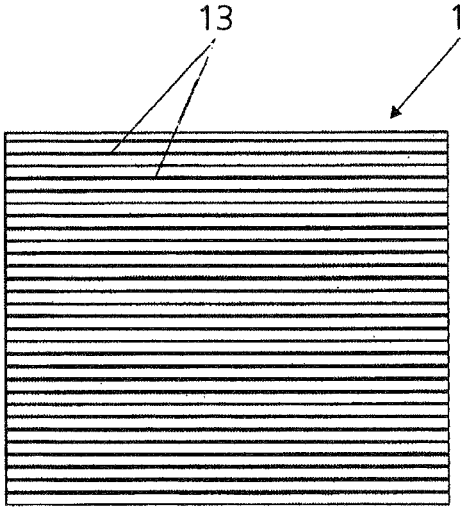
FIG. 14*b* shows an in-principle depiction of a section of knitted fabric in UHMWPE having rightwardly extending longitudinal ribs.
Figure 15:
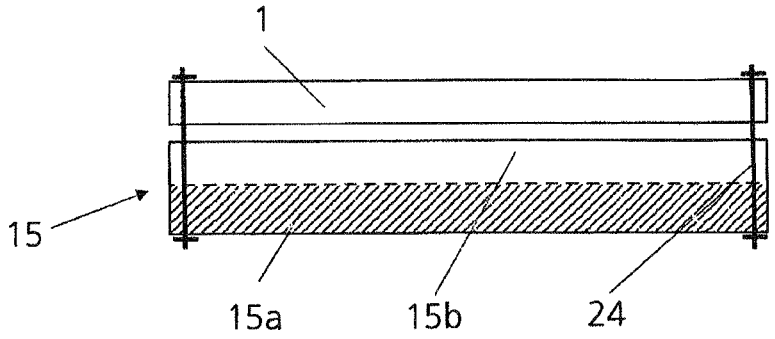
FIG. 15 shows an in-principle depiction of a section through a two-face weft-knitted fabric produced in a flame-retardant material by weft knitting with independently-movable needles and stitched to the inventive knitted fabric in UHMWPE.
Figure 16:
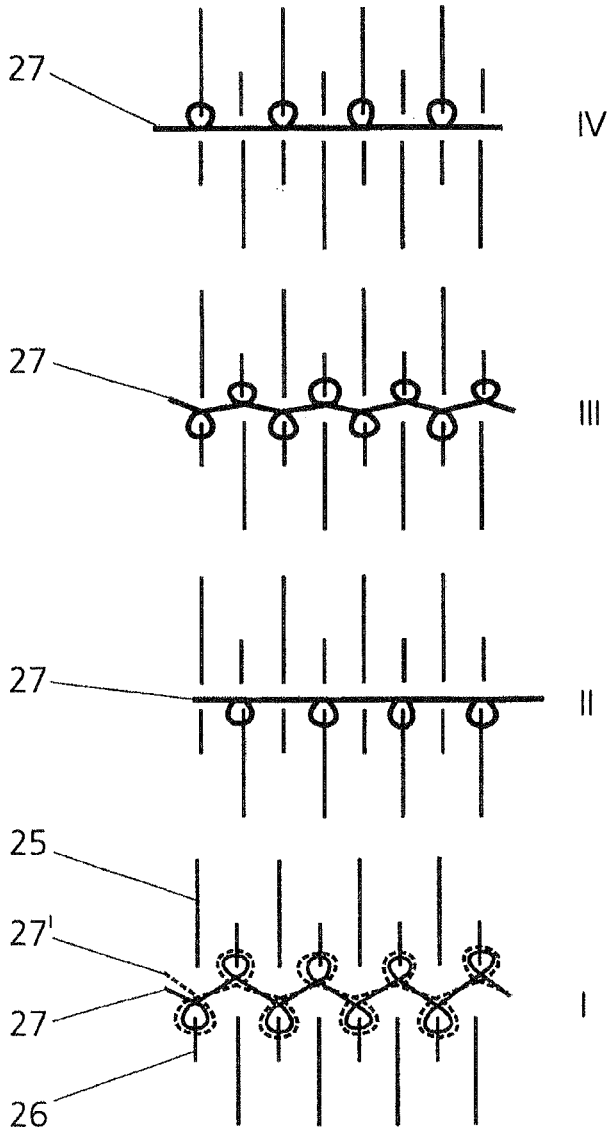
FIG. 16 shows an in-principle cross section through the inventive knitted fabric in UHMWPE.

Advantageous forms of the invention will become apparent from the exemplary embodiments described hereinbelow with reference to the drawing, where FIG. 1 shows a front view of the inventive undergarment configured as underpant in a first embodiment;

FIG. 2 shows a rear view of the underpant depicted in FIG. 1;

FIG. 3 shows a front view of the inventive undergarment configured as underpant in a second embodiment equipped with flame retardancy;

FIG. 4 shows a rear view of the underpant depicted in FIG. 3;

FIG. 5 shows a front view of the inventive undergarment configured as underpant in a third embodiment in a particularly hygienic configuration;

FIG. 6 shows a rear view of the underpant depicted in FIG. 5;

FIG. 7 shows an internal view of the FIG. 5 external view of the underpant;

FIG. 8 shows an internal view of the FIG. 6 external view of the underpant;

FIG. 9 shows a front view of the inventive undergarment configured as underpant in a fourth embodiment with pockets to accommodate protective packets;

FIG. 10 shows an internal view of the FIG. 9 external view of the underpant with a view of a pocket for receiving a genital-protective packet;

FIG. 11 shows an in-principle depiction of a cut through a protective packet consisting of eight plies;

FIG. 12 shows a plan view of a genital-protective packet;

FIG. 13 shows a plan view of a leg-protective packet;

FIG. 14*a* shows an in-principle depiction of a section of knitted fabric in UHMWPE having downwardly extending longitudinal ribs;

FIG. 14*b* shows an in-principle depiction of a section of knitted fabric in UHMWPE having rightwardly extending longitudinal ribs;

FIG. 15 shows an in-principle depiction of a section through a two-face weft-knitted fabric produced in a flame-retardant material by weft knitting with independently-movable needles and stitched to the inventive knitted fabric in UHMWPE; and FIG. 16 shows an in-principle cross section through the inventive knitted fabric in UHMWPE.

The production of textiles and the various methods of processing textiles are well known from the general prior art, and so only the specific features peculiar to the undergarment of the present invention are gone into hereinbelow.

All the features of the hereinbelow depicted undergarment, in particular the features depicted with reference to various embodiments of the undergarment, are combinable with each other in any desired manner. The features recited for any one embodiment may also be transferred to the other embodiments in order to produce further advantageous versions of the undergarment according to the present invention. Those features of embodiments that are not explicitly identified as essential to the present invention may further also be omitted.

The exemplary embodiments depicted hereinbelow show an undergarment constructed as underpant. However, the invention is not restricted thereto. An undervest in particular may also be concerned, and it is obtainable in a similar manner.

The depicted underpant relates to an underpant for men. An underpant for women, however, may also be constructed in a similar manner.

FIG. 1 shows a ballistic-protective underpant. The main area of the underpant is assembled from a fragment penetration inhibitor knitted fabric 1 in UHMWPE and at least one different further textile material 2, 200. A knitted fabric 1 in UHMWPE is an ultrahigh molecular weight polyethylene. A particularly suitable UHMWPE is marketed by the Dutch chemical company Royal DSM N.V. under the trade name of Dyneema®. Dyneema® is a high-strength polyethylene fiber having a tensile strength of 3 to 5 GPa. Dyneema® comprises a highly crystalline, highly oriented UHMWPE. Dyneema® fiber is particularly useful for producing the UHMWPE knitted fabric 1 provided according to the invention, but the invention is not restricted thereto.

FIGS. 1 and 2 show the undergarment in a form assembled essentially from three materials, viz., knitted fabric 1 in UHMWPE and two further textile materials 2, 200. However, alternatively, it is also possible to produce the underpant from just two materials, viz., knitted fabric 1 in UHMWPE and a further textile material, but also from more than three materials.

Knitted fabric 1 in UHMWPE is arranged in a first zone of the main area. The first zone is not further described in the exemplary embodiment because its extent is identical to that of knitted fabric 1 in UHMWPE.

The first zone, formed of knitted fabric 1 in UHMWPE according to FIGS. 1 and 2, occupies that part of the main area of the underpant which, when the underpant is donned correctly, adjoins the liver, the kidneys, the bladder, the digestive organs and the spleen completely or partially. Knitted fabric 1 in UHMWPE is further used in those areas of the underpant which adjoins the abdomen and the urinary tract and also the aorta and the venous system. Knitted fabric 1 in UHMWPE is further arranged in that part of the undergarment which adjoin the perineal and anal region when the underpant is donned correctly.

Venous system is to be understood as referring essentially to the principal blood vessels, damage to which by fragments or direct ballistic hits causes particularly severe bleeding.

According to FIGS. 1 and 2, knitted fabric 1 in UHMWPE protects the aforementioned regions provided the undergarment adjoins these at all. It is alternatively also possible for knitted fabric 1 in UHMWPE to protect only some of the aforementioned regions or else only a single one of the aforementioned regions. Any desired combinations are possible here, including in particular according to the likely risk to which the wearer is exposed.

Knitted fabric 1 in UHMWPE in the exemplary embodiment is a weft-knitted fabric produced by weft knitting with independently-movable needles. Knitted fabric 1 in UHMWPE has a basis weight of not less than 150 g/m$^2$, preferably 200 g/m$^2$, more preferably 250 g/m$^2$, most preferably 300 g/m$^2$. A basis weight of 320 to 330 g/m$^2$ is provided in the exemplary embodiment. The linear density of yarn 27 used for producing it is not less than 50 dtex and not more than 440 dtex, preferably not less than 80 dtex and preferably not more than 250 dtex. A yarn linear density of 110 dtex possibly +1-10 dtex is particularly preferable. The aforementioned values have turned out to be particularly suitable. However, the exemplary embodiment is not restricted thereto.

Knitted fabric 1 in UHMWPE preferably has a high stitch density. The underpant depicted in FIG. 1 and FIG. 2 preferably has a weight of 245 g/m$^2$+/−20 g/m$^2$ in size L in a one-ply configuration of knitted fabric 1 in UHMWPE.

The main area of the underpant shown in FIGS. 1 and 2 is assembled essentially from a front side 3, a rear side 4, two side panels 5, two pant leg cuffs 6 and a waistband 7. The front side 3 and the rear side 4 of the underpant may be connected together as a result of their also including the perineal and anal region and/or being connected to each other in this region. Preference must be given to a one-piece configuration of the first zone in a partial main area in knitted fabric 1 in UHMWPE where at least a partial area of the front side 3 and of the rear side 4 and also the underpant region adjoining the perineum and the anal region are encompassed.

Knitted fabric 1 in UHMWPE in the exemplary embodiment preferably occupies the aforementioned areas, which protect different regions of the body of the wearer. Knitted fabric 1 in UHMWPE, as is apparent from FIGS. 1 and 2, is used essentially in the region of the front side 3 and partially also in the region of the rear side 4.

The second textile material 2, which as shown in FIGS. 1 and 2 is preferably a mesh with open and air-permeable pores, is used in a second zone. The second zone is not separately identified in FIGS. 1 and 2, since it is identical to mesh 2. Mesh 2 is used to some extent in the region of the rear side 4 and to a lesser extent in the region of front side 3. It is advantageous when mesh 2 is formed of four pieces.

In the exemplary embodiment depicted in FIGS. 1 and 2, the third textile material 200 is formed of an elastic textile material, preferably a stretch fabric. The third zone is not separately identified in the exemplary embodiment as per FIGS. 1 and 2 because it is identical to the third textile material 200.

The third textile material 200 in the exemplary embodiment is a polyamide-elastane blend which preferably has a blending ratio of 73% polyamide to 27% elastane. However, the proportion of polyamide may preferably also be 20% larger or smaller, in which case the proportion of elastane is conformed correspondingly. Although a specific elastic textile material is mentioned in the exemplary embodiment, the invention is not restricted thereto. Any desired stretch material is suitable in principle for forming the third zone. The elastic textile material 200 in FIGS. 1 and 2 occupies essentially the area of the two side panels 5. The two pant leg cuffs 6 and the waistband 7 are further fabricated from the elastic textile material. However, especially the pant leg cuffs 6 and the waistband 7 may also be formed of some other material.

Knitted fabric 1 in UHMWPE, mesh 2 and elastic textile material 200 in the exemplary embodiment as per FIGS. 1 and 2 are assembled together such that they conjointly form the underpant. The materials 1, 2 and 200 overlap, if at all, preferably only in their edge regions. The interconnecting between materials 1, 2 and 200 may take any known form. Stitching the materials 1, 2 and 200 together in the region of their edges is preferable. Alternatively, one or two of the materials 1, 2 and 200 could also occupy the entire main area and the other materials then be correspondingly stitched thereonto. However, this is not preferable because the result may be worse wearing comfort and is a higher overall weight.

Waistband 7 formed of elastic material 200 is not only elastic due to the elastic textile material 200 but also has some adjustability. For this, the waistband 7 has a hook-and-loop closure. This may be realized in the form of two loop portions 8 and two hook portions 9, so the waistband 7 may be conformed to the wearer of the underpant.

The pant leg cuffs 6 are not only elastic due to the elastic textile material 200 but also have some adjustability. It is provided that the pant leg cuffs 6 are adjustable in order that the pant legs may be secured to the legs of the wearer of the underpant. This is realized in the exemplary embodiment as a result of the pant leg cuffs 6 each having hook-and-loop closures. These may have loop portions 10 and hook portions 11, ensuring adjustability. The configuration of the pant leg cuffs 6 such that they are adjustable to the wearer is a separate invention which can be realized even in isolation from the other features of the present underpant, in particular in an embodiment featuring a hook-and-loop closure system which is preferably assembled from loop portion 10 and hook portion 11.

The pant leg cuffs 6 and/or the described hook-and-loop closure at the pant leg cuffs 6 and/or at the waistband 7 may also be omitted.

FIGS. 1 and 2 also depict a genital region 12 integrated into front side 3.

The genital region 12 may optionally be specially protected, for example by using there two or more plies of knitted fabric 1 in UHMWPE.

In the embodiment as per FIGS. 1 and 2, it may initially be provided that knitted fabric 1 in UHMWPE be only used in one ply in the first zone. However, a multi-ply arrangement may also be provided here. Especially a double-ply arrangement of knitted fabric 1 in UHMWPE comes into consideration. It was determined in tests relating thereto that even a single-ply UHMWPE web-formed knit produced by weft knitting with independently-movable needles is sufficient to ensure good protection. A two-ply arrangement or even an arrangement featuring more than two plies is able to effect a distinct further increase in the protection against fragments, albeit with an increased underpant weight as a result.

Irrespective of the specific embodiment for the underpant, it may be advantageous for the loops of the knitted fabric 1 in UHMWPE to be formed such that a pattern of mutually parallel longitudinal ribs 13 is formed, as depicted by way of example in FIGS. 14*a* and 14*b*. The result is a particularly suitable capillary action effect to transport perspiration and liquid away from the body. In a two-ply configuration of knitted fabric 1 in UHMWPE, it may be advisable to place the two plies on top of each other in a plane-parallel arrangement twisted 90° relative to each other. A twisted arrangement of a second knitted fabric 1 in UHMWPE is depicted in FIG. 14*b*. If, then, the two knitted fabrics as per FIGS. 14*a* and 14*b* are superposed, the result is a two-ply knitted fabric in UHMWPE that has particularly good extensibility properties.

FIGS. 3 and 4 show a second version of an inventive underpant, featuring a flame-retardant and/or flameproof variation.

Parts bearing the same reference signs in FIGS. 3 and 4 as in FIGS. 1 and 2 may be configured as already described with reference to FIGS. 1 and 2, and so this is not further discussed hereinbelow. The second version depicted in FIGS. 3 and 4 differs from the first version depicted in FIGS. 1 and 2 essentially in that flame retardancy is provided. To this end, the materials which, in the first embodiment, were provided in addition to knitted fabric 1 in UHMWPE are partly or preferably wholly replaced by a flame-retardant textile material 14. In other words, proceeding from the embodiment as per FIGS. 1 and 2, the mesh and/or the elastic textile material 200 are replaced by the flame-retardant textile material 14. The flame-retardant textile material 14 may be an aramid-elastane blend, optionally with fractions of at least one further material, for example polyamide antistatic (PAAS). The flame-retardant textile material 14 may preferably be finished to be antibacterial. Forming the flame-retardant textile material 14 from a blend which includes at least aramid and elastane has the advantage that it also has elastic properties, which may be advantageous in particular in the region of the side panels 5, the pant cuffs 6 and the waistband 7.

The flame-retardant material 14 may consist of 70 to 95% aramid, 1 to 5% polyamide antistatic and elastane (e.g., Lycra) in a % fraction to produce overall a blend formed of the three materials to an extent of 98 to 100%. The use of a yarn consisting of aramid to an extent of 90%, of elastane to an extent of 7% and of 3% polyamide antistatic has turned out to be particularly suitable.

As not further depicted, the second version as per FIGS. 3 and 4 may also provide that a flame-retardant material 15 is used in the first zone which is formed by knitted fabric 1 in UHMWPE. The flame-retardant material 15 may in principle be the same material as also used as flame-retardant material 14. In the exemplary embodiment, however, the construction when flame retardancy should also be desired in the region of the first zone departs from the flame-retardant material 14. A flame-retardant textile material 15 which may preferably be used in the first zone is depicted in FIG. 15 by way of example. The flame-retardant material 15 as depicted there is assembled from a two-face weft-knitted fabric produced by weft knitting with independently-movable needles. Said two-face weft-knitted fabric produced by weft knitting with independently-movable needles is assembled from a blend 15*a*, which preferably includes at least aramid and elastane, and a knitted fabric 15*b* in UHMWPE, which are preferably bonded, for example adhered or laminated, together in a face-to-face fashion. The knitted fabric 15*b* in UHMWPE, which is a constituent part of flame-retardant material 15*b*, has a lower stitch density than knitted fabric 1 in UHMWPE and more particularly also has a lower basis weight. The design has turned out to be advantageous to still further augment the ballistic-protective effect of knitted fabric 1 in UHMWPE also by the flame-retardant textile material 15. However, other designs are also possible in the exemplary embodiment here.

The flame-retardant material 15, as depicted in FIG. 15 in exemplary fashion, is preferably stitched to knitted fabric 1 in UHMWPE by means of a rotary edge seam 24. Stitching by means of an edge seam 24 is also advantageous for a single-face configuration of flame-retardant material 15.

Blend 15*a* of flame-retardant textile material 15 may consist of 70 to 95% aramid, 1 to 5% polyamide antistatic and elastane (e.g., Lycra) in a % fraction to overall produce a blend formed of the three materials to an extent of 98 to 100%. The use of a yarn consisting of aramid to an extent of 90%, of elastane to an extent of 7% and 3% polyamide antistatic has turned out to be particularly suitable.

The third undergarment version depicted in FIGS. 5 to 8 differs from the version depicted in FIGS. 1 and 2 by a special form of hygiene engineering. The features which in FIGS. 5 to 8 bear the same reference signs as the features in FIGS. 1 and 2 may be identical, but also be omitted. The essential difference between the version depicted in FIGS. 5 to 8 versus the version according to FIGS. 1 and 2 is that in the first zone textile absorptive areas 16 are formed in the first zone, which in FIGS. 5 to 8 is occupied by knitted fabric 1 in UHMWPE, at least portionally on that, bottom side of knitted fabric 1 in UHMWPE which faces the wearer of the underpant. The further features of the underpant may be made in accordance with FIGS. 1 and 2 or else alternatively in accordance with FIGS. 3 and 4, although mixtures thereof are also possible. FIGS. 5 and 6 show an external view of front side 3 and of rear side 4 of the underpant, respectively. The seams can be seen therein to stitch the textile absorptive areas 16 to knitted fabric 1 in UHMWPE. The textile absorptive areas 16 themselves can be seen in FIGS. 7 and 8. FIG. 7 shows an internal view of front side 3 and FIG. 8 shows an internal view of rear side 4.

As is apparent from FIG. 7, knitted fabric 1 in UHMWPE is interrupted in each pant leg by respectively four textile absorptive areas 16 in the form of strips. The area of textile knitted fabric 1 in UHMWPE, which on front side 3 adjoins the wearer of the underpant, is thus divided by the textile absorptive areas 16 into a larger number of fields, six per pant leg in the exemplary embodiment. They serve to interrupt the tracks/streams of sweat. On reaching the textile absorptive areas 16, the sweat is particularly rapidly withdrawn from the body and transported to the surface. The depicted course of the strip-shaped absorptive areas 16 has turned out to be particularly suitable, although the exemplary embodiment is not restricted thereto. As is further apparent from FIG. 7, the genital region 12 is preferably formed completely of a textile absorptive area 16.

As is apparent from FIG. 8, the perineal and anal region, which forms part of the rear side 4 and/or extends from the front side 3 to the rear side 4, is preferably also formed of a textile absorptive area 16. A textile absorptive area 16 is further also used in the region of the renipelvic region. The rear side 4 further has a strip-shaped textile absorptive area 16, subdividing knitted fabric 1 in UHMWPE at the rear side 4 into altogether four fields.

The textile absorptive areas 16 preferably adjoin directly to the body of the wearer of the undergarment.

An otherwise undepicted, particularly preferred construction results for the textile absorptive area 16 on using a laminate comprising a layer of activated carbon. In fact, the laminate preferably has a three-ply construction wherein the activated carbon layer is the middle layer. That layer of the textile absorptive area 16 which faces the body of the wearer of the undergarment may preferably be formed of a cotton-elastane blend or of a blend comprising at least cotton and elastane. The third layer of the textile absorptive area 16, which adjoins knitted fabric 1 in UHMWPE, may preferably be formed of polyamide or a blend comprising polyamide.

FIGS. 5 to 8 depict the underpant in a design featuring three zones relating to the textile absorptive areas 16. However, a design with just two zones relating to the textile absorptive areas 16 is also possible here. As mentioned above, a flame-retardant variation may also be provided alternatively or additionally. More particularly, no mesh 2 and/or no elastic textile material 200 need be used in FIGS. 5 to 8. Any desired mixtures are possible between the versions already described with reference to FIGS. 1 and 2 and FIGS. 3 and 4 and still to be described hereinbelow with reference to FIGS. 9 and 10.

FIGS. 9 and 10 show a fourth version of the underpant. FIG. 9 shows an external view of front side 3, while FIG. 10 shows an internal view of front side 3. The inside surface and the outside surface of front side 3 may be designed independent of each other, i.e., the hereinbelow depicted version in FIG. 9 need not be realized in order to realize the design depicted in FIG. 10—and vice versa.

FIG. 9 shows that in the regions adjoining the thighs when the undergarment is donned correctly there are formed pockets 17 whereinto are insertable protective packets 18, which in the present case is a leg-protective packet 18, conformed to the particular pocket 17. FIG. 10 similarly shows that a pocket 19 may be provided in the genital region 12 to accommodate a protective packet 20, which in the present case is a genital-protective packet 20. This genital-protective packet 20 substantially conforms to the pocket 19 for the genital region 12.

The leg-protective packets 18 and/or the genital-protective packet 20 may be formed of any desired material inhibiting the penetration of fragments, preferably of a knitted fabric 1 in UHMWPE. The exemplary embodiment provides that the leg-protective packets 18 and the genital-protective packet 20 are formed of the same knitted fabric in UHMWPE of which knitted fabric 1 in UHMWPE also consists and occupies the first zone of the main area of the underpant.

The leg-protective packets 18 may be introduced into the pockets 17 in any desired manner. The leg-protective packets 18 are preferably inserted into the pockets 17 which each have an optionally closeable insertable opening 17*a* in an upper region, preferably extending sideways and preferably vertically. "Upper region" in this connection is to be understood as meaning that the region is up when the undergarment is on a wearer who is standing.

As is apparent from FIG. 9, it may be advantageous for the leg-protective packets 18 to be equipped with securing means 21, for example a hook portion of a hook-and-loop closure, to attach the leg-protective packet 18 to the underpant after said packet 18 has been inserted into the pockets 17. Of particular preference in this connection is attachment to the loop portion 8 of waistband 7. The pockets 17 may preferably have on their outside surface a slot 17*b* to pass securing means 21 therethrough.

Pockets 17 and leg-protective packets 18 are preferably coordinated with each other in shape. A particularly suitable shape for the leg-protective packets 18 is apparent from FIG. 13.

The pockets 17 may consist of any desired material. Preferably, the pockets 17 are formed of a mesh, more preferably of an open and air-pervious mesh with pores which may optionally be identical to mesh 2. It may be advantageous for the pockets 17 to be flame retardant.

The pockets 17 in the exemplary embodiment are provided on the outer surface of front side 3. But in principle it is also possible for pockets 17 to be formed on the inside surface of front side 3.

FIG. 10 shows a pocket 19 for the genital-protective packet 20 to be formed on the inside surface of front side 3. However, formation on the outer surface of front side 3 is also possible here. Pocket 19 may be made similarly to pockets 17. An advantageous version may result on knitted fabric 1 in UHMWPE to have at least in the genital region 12 a two-ply construction and an insertable opening 19*a*, so the genital-protective packet 20 can be inserted between the two plies of knitted fabric 1 in UHMWPE. In this case, a separate formation of a pocket 19, for example in mesh, may be eschewed. FIG. 10 depicts a design of pocket 19 in mesh and having an insertable opening 19*a*.

It is advantageous for the leg-protective packets 18 and/or the genital-protective packet 20 to be formed of two or more plies of knitted fabric 1 in UHMWPE. It is advantageous for at least four plies of knitted fabric 1 in UHMWPE to be superposed to form the protective packets 18, 20. A particularly suitable version to form the leg-protective packet 18 depicted in FIG. 13 and/or the genital-protective packet 20 depicted in FIG. 12 is apparent from the sectional depiction in FIG. 11. What is provided here is that the protective packets 18, 20 are formed by preferably eight superposed layers of knitted fabric 1 in UHMWPE. It may be advantageous here for four plies of knitted fabric 1 in UHMWPE to be quilted with one another in each case. Corresponding quilting seams/turns 22 are depicted in FIG. 12 and FIG. 13 respectively. The resulting two sub-packets of four knitted fabrics 1 in UHMWPE in each case may subsequently be stitched together, preferably at their edges only. A corresponding edge seam 23, also known as a welt, is in turn depicted in FIGS. 12 and 13.

FIG. 16 shows an in-principle cross section through knitted fabric 1 in UHMWPE. However, the invention is not restricted thereto. What is depicted is a knitted fabric 1 in UHMWPE being produced via a system I to IV. The vertical strokes depict long needles 25 and short needles 26, encircled by a loop of yarn 27 which forms knitted fabric 1 in UHMWPE. Yarn 27 may be selected in accordance with the specification already recited in the figure description, but is not restricted thereto.

Preferably, knitted fabric 1 in UHMWPE is formed by weft knitting with independently-movable needles on a circular knitting machine; production on a flatbed knitting machine is alternatively also possible.

As is apparent from system I to IV in FIG. 16, a doubled yarn enters system I. This is depicted in system I of FIG. 16 by yarn 27 being depicted as a continuous line and a yarn 27' as a broken line. It is in principle also possible to use only a single yarn in system I of FIG. 16, but a doubled yarn has turned out to be particularly suitable. Systems III to IV are each entered only by a single yarn 27.

In the construction depicted in FIG. 16, the ballistic knitted fabric 1 in UHMWPE is produced by weft knitting with independently-movable needles. An interlock setting on the knitting machine may be preferable for this.

It would be possible in principle to let doubled yarn 27 also enter one or more systems II, III or IV, but this depends in particular also on the desired yarn linear density.

It is possible in principle to operate the knitting machine in the so-called rib setting.

It is possible in principle for the knitted structures also to be formed differently than depicted. The construction depicted in FIG. 16, however, has turned out to be particularly suitable for producing the knitted fabric 1 in UHMWPE provided according to the present invention, in particular in conjunction with the properties recited as preferred for knitted fabric 1 in UHMWPE and/or yarn 27 in UHMWPE as per the present figure description.

While Applicant's invention has been described in detail above with reference to specific embodiments, it will be understood that modifications and alterations in embodiments disclosed may be made by those practiced in the art without departing from the spirit and scope of the invention. All such modifications and alterations are intended to be covered. In addition, all publications cited herein are indicative of the level of skill in the art and are hereby incorporated by reference in their entirety as if each had been individually incorporated by reference and fully set forth.

LIST OF REFERENCE SIGNS

1 Knitted fabric
2 Mesh
3 Front side
4 Rear side
5 Two side panels
6 Two pant leg cuffs
7 Waistband
8 Two loop portions
9 Two hook portions
10 Loop portions
11 Hook portions
12 Genital region
13 Longitudinal ribs
14 Flame-retardant material
15 Flame-retardant material
**15*a*** Blend
**15*b*** Knitted fabric
16 Textile absorptive areas
17 Pockets
**17*a*** Insertable opening
**17*b*** Slot
18 Leg-protective packets
19 Pocket
**19*a*** Insertable opening
20 Genital-protective packet
21 Securing means
22 Quilted turns
23 Edge seam
24 Rotary edge seam
25 Long needles
26 Short needles
27 Yarn
200 Textile material

The invention claimed is:

1. An undergarment providing ballistic protection, wherein a base area of the undergarment is composed of a fragmentation-penetration inhibiting knitted fabric made of UHMWPE and of at least one further textile material being different from the fragmentation-penetration inhibiting knitted fabric made of UHMWPE, wherein UHMWPE represents an ultrahigh molecular weight polyethylene, wherein the knitted fabric made of UHMWPE is produced by weft-knitting with independently-movable needles and has a basis weight of not less than 150 g/m$^2$, wherein a linear density of yarn used for producing the knitted fabric made of UHMWPE is not less than 50 dtex and not more than 440 dtex, wherein the knitted fabric made of UHMWPE is arranged in a first zone of the base area, wherein the first zone forms at least a part of the base area of the undergarment which is adapted to at least partially cover at least one of the hereinbelow recited regions of the human body, a) internal organs, b) liver, kidney, bladder, digestive organs and spleen, c) abdomen and urinary tract, d) aorta and venous system, e) perineum and anal region, and wherein loops of the knitted fabric made of UHMWPE are formed such that a pattern of mutually parallel longitudinal ribs are formed in principal areas of the knitted fabric, wherein at least two layers of the knitted fabric made of UHMWPE are arranged on top of each other in the first zone by being twisted 90° relative to each other and in a parallel plane alignment to each other, and wherein the at least one further textile material forms at least one second zone and at least one third zone of the base area, wherein the further textile material arranged in a third zone is formed as an elastic textile material, wherein the at least one further textile material and the knitted fabric made of UHMWPE are stitched together and wherein in a region adapted to adjoin the thighs or a genital region, there is formed at least one pocket including insertable protective packets conformed to the pocket, wherein the protective packets are formed of a fragmentation-penetration inhibiting knitted fabric made of UHMWPE and wherein the protective packets are formed by at least four superposed plies of knitted fabric made of UHMWPE.

2. The undergarment as claimed in claim 1, wherein the knitted fabric made of UHMWPE and the at least one further textile material are stitched together in regions of their mutually adjoining edges and wherein the knitted fabric made of UHMWPE and the at least one further textile material overlap at most in the regions of the mutually adjoining edges.

3. The undergarment as claimed in claim 1, wherein the undergarment has pant legs which have pant leg cuffs at the ends of the pant legs to secure the pant legs in place, wherein the pant leg cuff is elastic or adapted to be adjustable to the wearer of the undergarment.

4. The undergarment as claimed in claim 1, wherein the further textile material arranged in the second zone is formed as a textile mesh having open and air-permeable pores.

5. The undergarment as claimed in claim 1, wherein, in the first zone, textile absorptive areas for perspiration removal are formed at least sectionwise on a bottom side of knitted fabric made of UHMWPE which is adapted to face the wearer of the undergarment.

6. An undergarment providing ballistic protection, wherein a base area of the undergarment is composed of a fragmentation-penetration inhibiting knitted fabric made of UHMWPE and of at least one further textile material being different from the fragmentation-penetration inhibiting knitted fabric made of UHMWPE, wherein UHMWPE represents an ultrahigh molecular weight polyethylene, wherein the knitted fabric made of UHMWPE is produced by weft-knitting with independently-movable needles and has a basis weight of not less than 150 g/m$^2$, wherein a linear density of yarn used for producing the knitted fabric made of UHMWPE is not less than 50 dtex and not more than 440 dtex, wherein the knitted fabric made of UHMWPE is arranged in a first zone of the base area, wherein the first zone forms a part of the base area of the undergarment which is adapted to at least partially cover at least one of the hereinbelow recited regions of the human body, a) internal organs, b) liver, kidney, bladder, digestive organs and spleen, c) abdomen and urinary tract, d) aorta and venous system, e) perineum and anal region, and wherein loops of the knitted fabric made of UHMWPE are formed such that a pattern of mutually parallel longitudinal ribs are formed in principal areas of the knitted fabric, and wherein the at least one further textile material forms at least one second zone and at least one third zone of the base area, wherein the further textile material arranged in the third zone is formed as an elastic textile material, wherein the at least one further textile material and the knitted fabric made of UHMWPE are stitched together, wherein in a region adapted to adjoin the thighs or a genital region, there is formed at least one pocket including insertable protective packets conformed to the pocket, wherein the protective packets are formed of the fragmentation-penetration inhibiting knitted fabric made of UHMWPE and wherein the protective packets are formed by at least four superposed plies of knitted fabric made of UHMWPE, and wherein the knitted fabric made of UHMWPE and the at least one further textile material are stitched together in regions of the mutually adjoining edges and wherein the knitted fabric made of UHMWPE and the at least one further textile material overlap at most in regions of the mutually adjoining edges.

7. An undergarment providing ballistic protection, wherein a base area of the undergarment is composed of a fragmentation-penetration inhibiting knitted fabric made of UHMWPE and of at least one further textile material being different from the fragmentation-penetration inhibiting knitted fabric made of UHMWPE, wherein UHMWPE represents an ultrahigh molecular weight polyethylene, wherein the knitted fabric made of UHMWPE is produced by weft-knitting with independently-movable needles and has a basis weight of not less than 150 g/m$^2$, wherein a linear density of yarn used for producing the knitted fabric made of UHMWPE is not less than 50 dtex and not more than 440 dtex, wherein the knitted fabric made of UHMWPE is arranged in a first zone of the base area, wherein the first zone forms a part of the base area of the undergarment which is adapted to at least partially cover at least one of the hereinbelow recited regions of the human body, a) internal organs, b) liver, kidney, bladder, digestive organs and spleen, c) abdomen and urinary tract, d) aorta and venous system, e) perineum and anal region, and wherein loops of the knitted fabric made of UHMWPE are formed such that a pattern of mutually parallel longitudinal ribs are formed in principal areas of the knitted fabric, and wherein at least one further textile material forms at least one second zone and at least one third zone of the base area, wherein the further textile material arranged in the second zone is formed as a textile mesh having open and air-permeable pores and wherein the further textile material arranged in the third zone is formed as an elastic textile material, wherein the at least one further textile material and the knitted fabric made of UHMWPE are stitched together, wherein in a region adapted to adjoin the thighs or a genital region, there is formed at least one pocket including insertable protective packets conformed to the pocket, wherein the protective packets are formed of a fragmentation-penetration inhibiting knitted fabric made of UHMWPE and wherein the protective packets are formed by at least four superposed plies of knitted fabric made of UHMWPE, and wherein the undergarment has pant legs which have pant leg cuffs at the ends of the pant legs to secure the pant legs in place, wherein the pant leg cuffs are elastic or adapted to be adjustable to the wearer of the undergarment.

* * * * *